US005727584A

United States Patent [19]

Stanec

[11] Patent Number: 5,727,584

[45] Date of Patent: Mar. 17, 1998

[54] CANE INCLUDING ATTACHMENT PLUG

[76] Inventor: George Stanec, 15 Secor Rd., Scarsdale, N.Y. 10583

[21] Appl. No.: 695,232

[22] Filed: Aug. 7, 1996

Related U.S. Application Data

[63] Continuation-in-part of Ser. No. 396,602, Mar. 1, 1995, abandoned.

[51] Int. Cl.[6] ..... A45B 1/00

[52] U.S. Cl. ..... 135/77; 135/65; 135/86

[58] Field of Search ..... 135/65, 77, 79, 135/82, 83, 84, 86

[56] References Cited

U.S. PATENT DOCUMENTS

| | | | |
|---|---|---|---|
| 994,194 | 6/1911 | Pratt | 135/82 |
| 1,055,111 | 3/1913 | Wilcox | 135/84 |
| 1,429,429 | 9/1922 | Hipwood | 135/84 |
| 1,464,057 | 8/1923 | Bell | 135/83 |
| 1,663,622 | 3/1928 | Atkinson | 135/82 |
| 2,888,022 | 5/1959 | Fanning | 135/82 |
| 3,467,117 | 9/1969 | Lucibello | 135/77 |
| 3,731,698 | 5/1973 | Buchalter | 135/84 |
| 5,103,850 | 4/1992 | Davis | 135/77 X |
| 5,353,825 | 10/1994 | Davis | 135/77 X |
| 5,495,867 | 3/1996 | Block | 135/65 |

*Primary Examiner*—Wynn E. Wood
*Attorney, Agent, or Firm*—Eliot S. Gerber

[57] ABSTRACT

A cane having a handle and a shaft with a tip section has an elastomeric attachment plug with a bore therethrough, with the tip section of the pole captured by the bore. A bottom face of the attachment plug has a cavity so that when the plug is pushed on the ground it tends to form a partial vacuum. The top face supports a disk-like basket connected to the shaft.

11 Claims, 5 Drawing Sheets

CANE INCLUDING ATTACHMENT PLUG

RELATED APPLICATION

This application is a continuation-in-part application partly based on Ser. No. 08/396,602, filed Mar. 1, 1995, abandoned, entitled "Attachment Plug For Ski Poles".

1. Field of the Invention

The present invention relates to walking canes and more particularly to a lightweight walking cane.

2. Relevant Prior Art

At the present time canes (walking canes) generally consist of a wooden handle integral with a wooden shaft. Often the shaft's tip is covered by a rubber cover. For example, a rubber crutch tip is shown in Lucibello U.S. Pat. No. 3,467,117. Alternatively, a tubular metal cane is often used by older persons, as such tubular canes are lighter in weight than wooden canes.

Recently thin carbon-impregnated plastic resin shafts have been used in certain types of ski poles. Also it is common for ski poles to have a disk-like basket attached to their shafts. The purpose of the basket is to provide lift, against the snow, when the ski pole is jammed into the snow. However, such baskets have not been used on canes, as canes are not generally used to walk on snow.

A fastening device having a ferrule of nylon, a sheet metal fastener and a stick end is shown in Parkin U.S. Pat. No. 3,007,726.

SUMMARY OF THE INVENTION

An objective of the present invention is to provide a cane which will provide a steady support for use on both soft and hard surfaces.

The present invention provides a plug attachment to the tip of a lightweight shaft. The shaft is a thin, yet strong, tube of a carbon-impregnated plastic resin or titanium.

The present invention provides an elastomeric plug attachment of lightweight polyethylene micro-cell foam which is affixed to the tip of the lightweight shaft by pressing the shaft downward into the bore of the plug. The tip section of the shaft is entirely contained within the plug.

The weight of each plug is approximately 2 ounces (57 grams), so it does not place an additional weight burden upon the user. The plug is comprised of flexible and resilient material which is sufficiently sensitive to the terrain, so that it can communicate sensorial feedback to the user. Tactile responses are transmitted from the ground to a basket (disk-like membrane) of the shaft, the shaft and hand grip (handle). The user can sense the nature of the terrain in his path and adjust his movements in response. The plug has a cavity on its bottom face to provide a partial suction effect. In one embodiment the plug may be inverted and has protrusions on its opposite face, to provide added friction. The width of the plug at its base is preferably about 2 inches across, many times the width of the tip of a shaft, to provide stability.

BRIEF DESCRIPTION OF THE DRAWINGS

A practical example of the invention is hereinafter described in greater detail with the aid of the drawings, in which.

DETAILED DESCRIPTION

Figure 1:
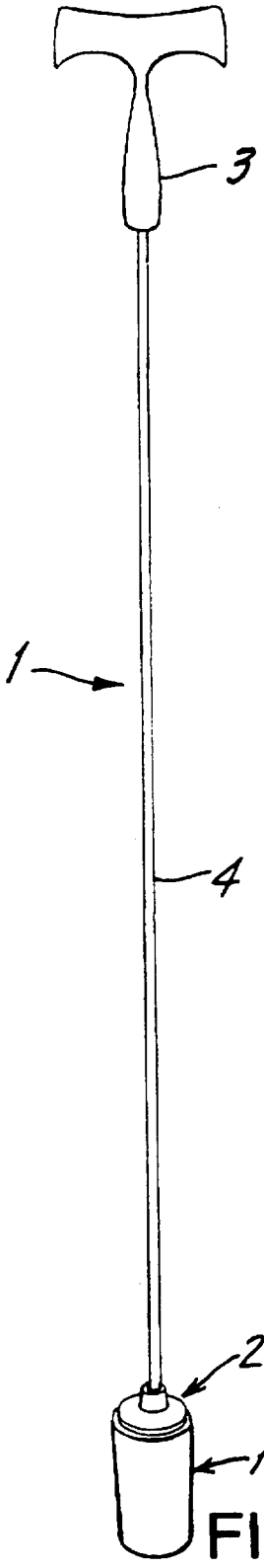
FIG. 1 is an elevational view of the first embodiment of the cane of the present invention with the attachment plug of FIG. 2 attached on the end of the cane.
Figure 3:
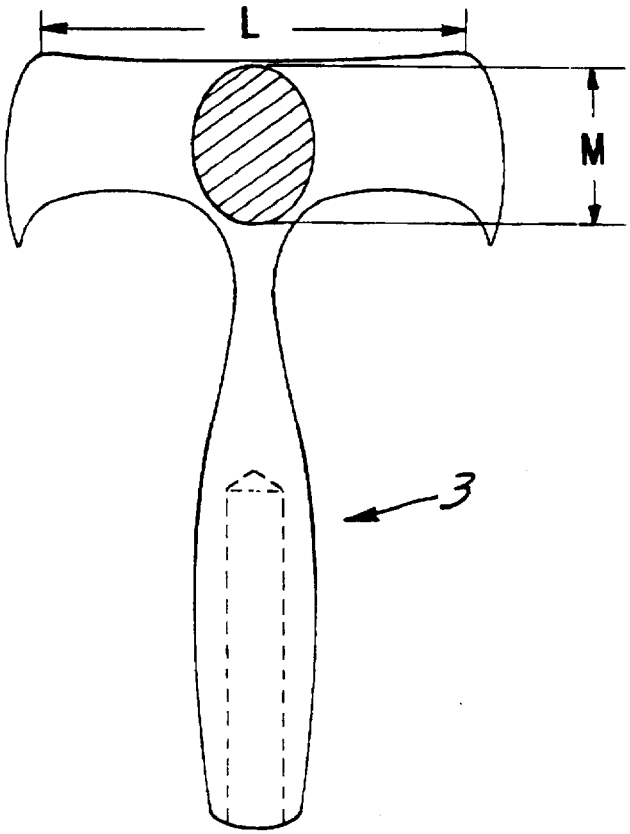
FIG. 3 is the first embodiment of a cane handle.
Figure 2:
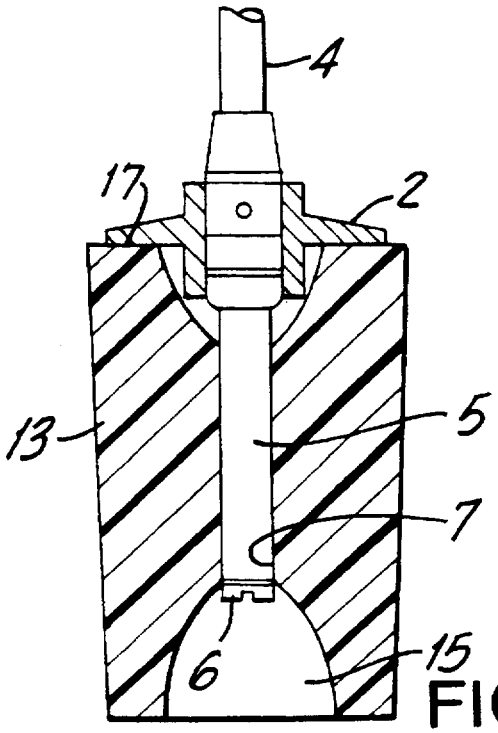
FIG. 2 shows the first embodiment of a cane attachment plug, the drawing being an interior cross-section.
Figure 4:
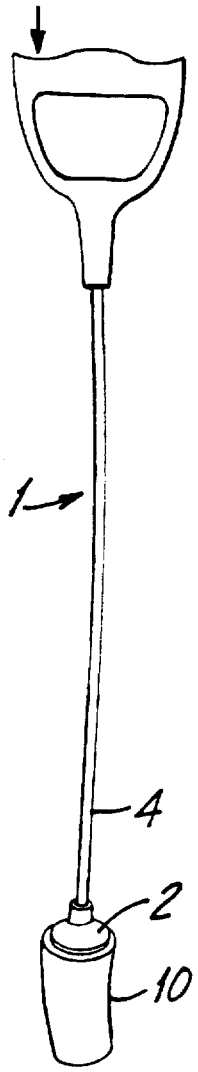
FIG. 4 is an elevational view as in FIG. 1, but the carbon graphite composite shaft is shown responding to forces generated by hand in support of the user's upper torso weight when walking.

As shown in FIGS. 1–3, the cane 1 has a shaft 4 (round and hollow in cross-section) and a flexible disk-like basket 2 fixed to the shaft. The shaft 4 has a bottom tip section 5 terminating in a tip 6. The tip section 5 is pushed into an attachment plug 10 until tip section 5 fills the longitudinal bore 7 of attachment plug 10. A handle 3 is attached at the upper end of shaft 4.

In the embodiment of FIG. 1–3, the bottom of the flat disk-like basket 2 of shaft 4 fits on top of the top face rim 17 of plug 10. The basket 2 is of plastic, preferably Delrin (TM), and the preferable outer diameter is 1 7/16, but it may range from 1 to 1 14/16 inches. The attachment plug 10 is of lightweight polyethylene micro-cell foam having a density in the range of 15–40 PCF. Its weight is preferably 2 ounces; but is in the preferred range of 1 to 4 ounces and is less than 5 ounces. It is most preferable to use 20 PCF (Pounds Cubic Foot) for light weight ("("soft") load transfer; 27 PCF for medium weight ("medium") load transfer, and 35 PCF for heavy weight ("hard") load transfer. In this embodiment the preferable dimensions of the plug 10 are: outer diameter of 1 5/8 inches (at the bottom), but it may range from 1 1/4 to 2 inches; inner diameter of bore (bore 7) 3/16-inch but it may range from 2/16 to 1/4 inches; diameter of the cavity 15 at the plug's bottom face of 15/16 inches but it may range from 12/16 to 1 1/16 inches; and a height of 2 5/8 inches, but may range from 2 1/8 to 4 3/8 inches.

Figure 7:
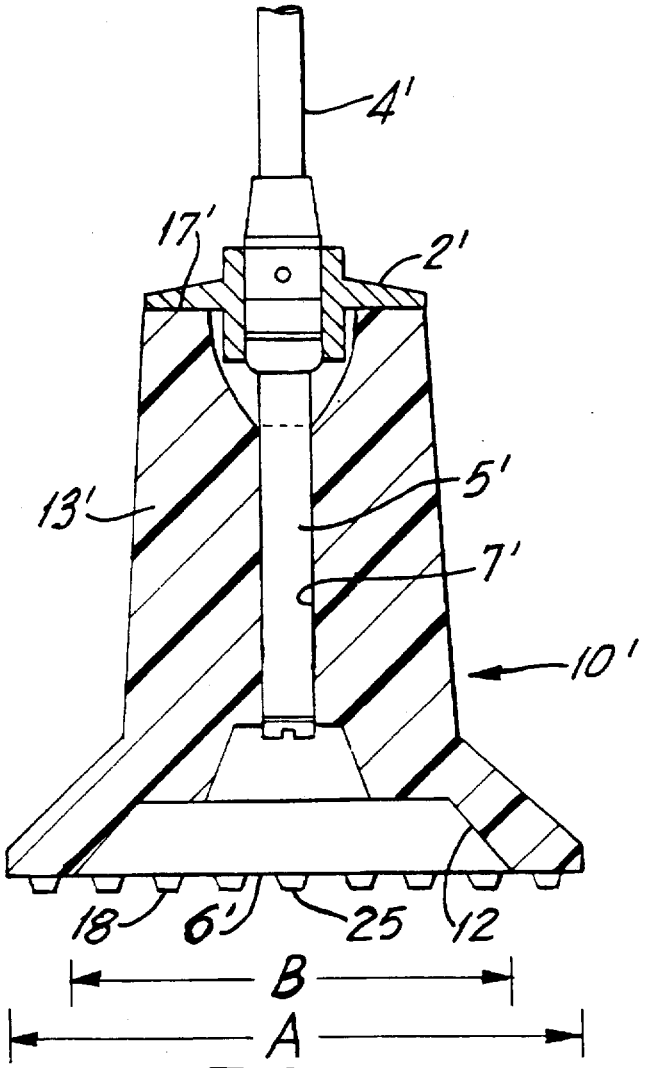
FIG. 7 shows a second embodiment of an attachment plug according to the present invention, the drawing being an interior cross-section.

In the embodiment of FIG. 7, the attachment plug 10 has a wide base to provide more stability for the user, which makes the cane 10 self-standing. The attachment plug 10' is of an elastomeric, flexible and resilient material; preferably lightweight polyethylene micro-cell foam having a density in the range of 27–40 PCF and preferably about 32 PCF. Its preferred weight is in the range of 1 to 4 ounces and is less than 5 ounces. When the tip section 5' of the shaft 4' is pushed into the bore 7', the basket 2' will be positioned within the conical wall 12' and the bottom 6' of the tip section 5' will be at the bottom of the bore 7'. The preferred internal diameter, i.e., the preferred diameter distance between the left interior wall and the right interior wall is 2.75 inches at the top of the conical wall 12', and 1.75 inches at its bottom.

In the embodiment of FIG. 7, the body 13 of the attachment plug 10' has a lower integral rim 16' forming a rounded cavity 15'. The preferred dimensions are: rim 16', outer diameter "A" of the rim 3,615 inches and the inner diameter "B" of the rim 2.75 inches. The preferred angle of the conical wall 12 is 45° and in the range of 30°–60° from the imaginary axis 25. The cavity 15' is preferably 1-inch diameter at its mouth (bottom face of attachment 10) and ¾-inch deep. The attachment plug 10' is preferably 3.615 inches high and its body, at the vertical center, has a cross-sectional diameter of 1⅞ inch. The protrusions 18' on the face of the rim are preferably ⅛-inch high, ¼ inch wide (at the base) and there are eighteen protrusions. The bore 5 preferably has a diameter of ¼ inch and is 2 inches long. The basket 2' outer diameter is preferably 1⅞ inch.

The attachment plugs 10 and 10' are produced by using a machine utilizing the Rim System (Reaction Injection Molding).

Figure 5:
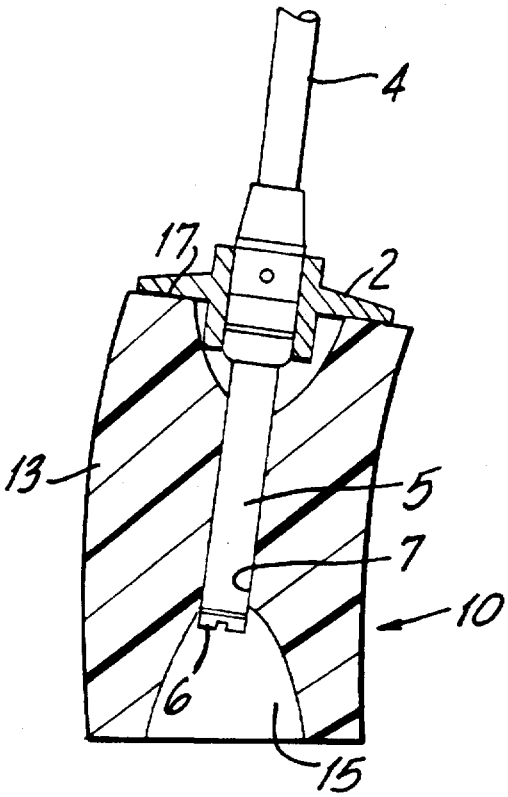
FIG. 5 is a view similar to FIG. 2 but with the plug being flexed under the pressure when the user is walking.

The attachment plugs 10 and 10' add very little to the mass and weight of the cane. The cavity 15 or cavity 15' provides a suction (partial vacuum) which is useful on hard surfaces. When the ground is icy or wet the attachment plug of FIG. 5 can be inverted.

Figure 8:
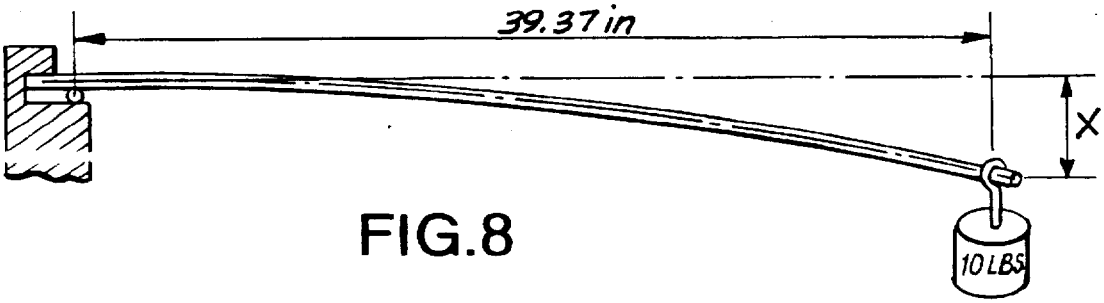
FIG. 8 shows a benchmark indicator test arrangement and parameters for the carbon graphite composite can shaft of the cane.
Figure 6:
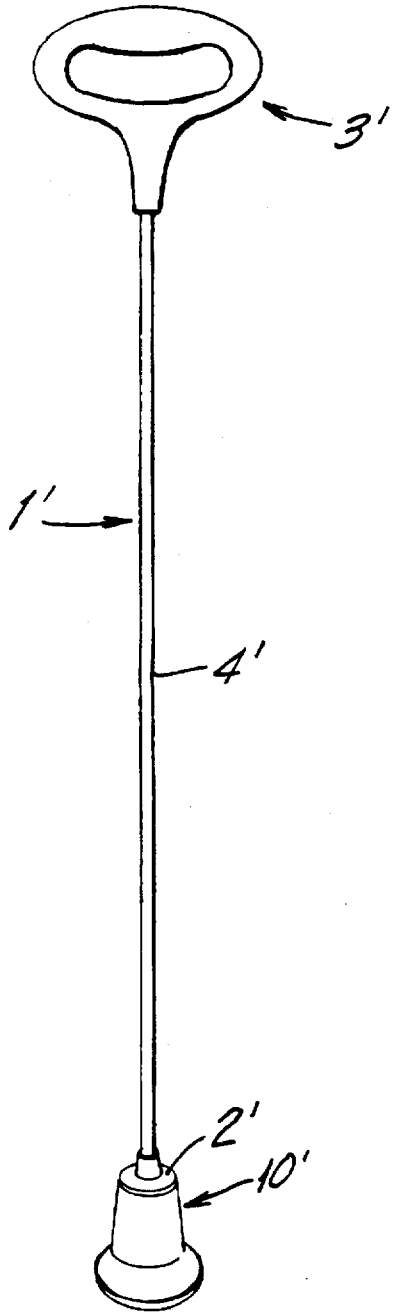
FIG. 6 is an elevational view of the attachment plug of FIG. 7 on the end of a cane.

The attachment plugs 10 and 10' provide stability to the cane or crutch, especially on icy or wet pavements. The shafts 4 and 4' are of a strong and lightweight tubular material, preferably of a carbon graphite composite material. The shafts are formed by wrapping 2–5 layers of a thread of graphite on a mandrel and then impregnating the tube of threads with plastic under heat and pressure. The outer diameter of shafts 4 and 4' is preferably 0.245±0,005 inches and its inner diameter is 0.42±0.005 inches. The range of the outer diameter is from 0.32 to 0.62 inches. The standard deflection, shown on FIG. 8, is 6 in.±1 in., preferably not more than 6 in. The weight of the shaft, either plastic or titanium, is preferably 2.82 oz. for a shaft having a length of 39.375 in. and in the preferred range of 1.0 to 4 ounces and less than 5 ounces.

Alternatively, the shafts 4 and 4' are of a titanium and have conical form. The attachment plug's 10 end of the shaft 4 has preferably the outer diameter 0.42±0,005 inches but it may range from 0.32 to 0.62 inches; and the wall thickness is 0.1 inches. The handle end of the shaft 4 has the outer diameter of 0.60±0.005 inch, which may range from 0.42 to 0.80 inch; and has a wall thickness of 0.030 inch. The shaft's weight is preferably 2.82 ounces for a 39.375 inch shaft length and within the preferred range of 1–4 ounces and is less than 5 ounces. The standard deflection X, shown in FIG. 8, is 9 in ±1 in., preferably not more than 9 in.

According to the invention, tactile information from the ground is transmitted to the pole basket 2 or 2' and tip section 5 or 5'. This information then travels up the shaft 4 or 4' of the cane, reaches the hand grip and finally is felt by the user in his hand.

As shown in FIG. 7, a cane having a tip section 5' is connected to the attachment plug 10' by forcing the cane's tip 5' into its bore 7'.

The term "cane", as used in the claims, includes a crutch, as the plug may be used on a crutch.

Figure 9:
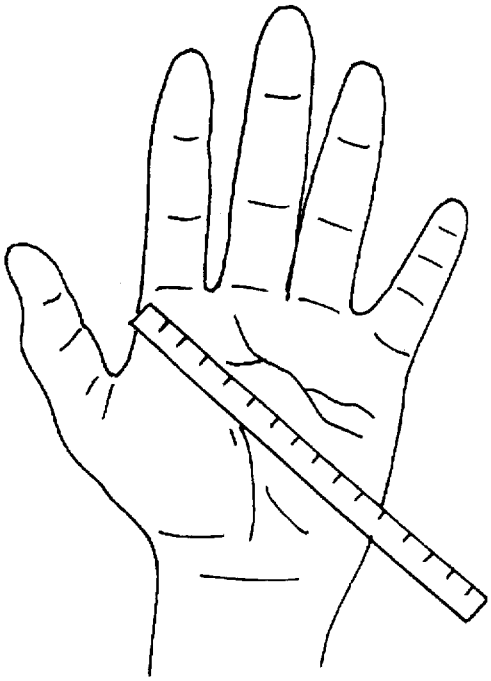
FIG. 9 is a top plan view showing measuring the palm of the user's hand.
Figure 10:
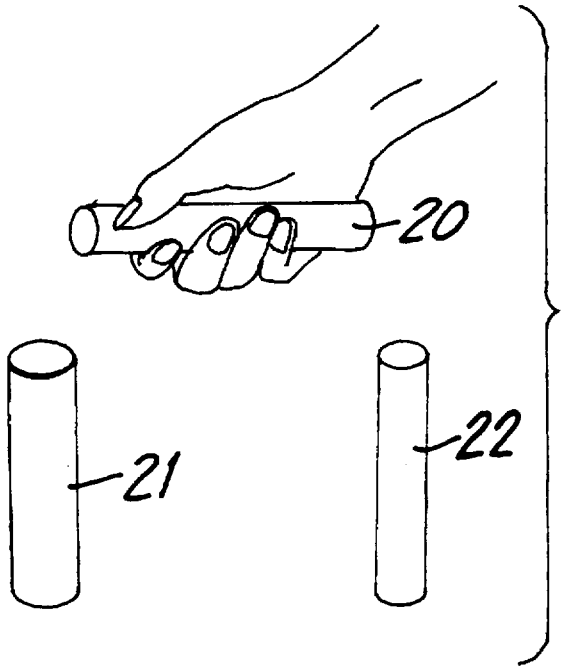
FIG. 10 is a perspective view of the user's hand and three measurement sticks.

The handle is preferably of lightweight wood or plastic. The handle, length (L) and handle module (M), see FIG. 3, are based on the anatomical measurements of the palm width (FIG. 9) and the hand grip (FIG. 10). To determine the handle length, the first step is to measure the palm width as shown in FIG. 9. The second step is to add a fixed amount in the range of 5–15 mm, and preferably 10 mm, to the palm width. Then, the nearest highest size of the result (R) is found from the table below:

| R | <90 | 90 < R < 100 | 100 < R < 105 | 105 < R < 110 | 110 < R < 120 | 120 < R < 130 |
|---|---|---|---|---|---|---|
| L | 90 | 100 | 105 | 110 | 120 | 130 |

For example: A palm width is 104 mm. Then R is equal to 104 mm plus 10 mm which is 114 mm. The nearest highest size is 120 mm. Thus, the handle length is 120 mm.

Figure 11:
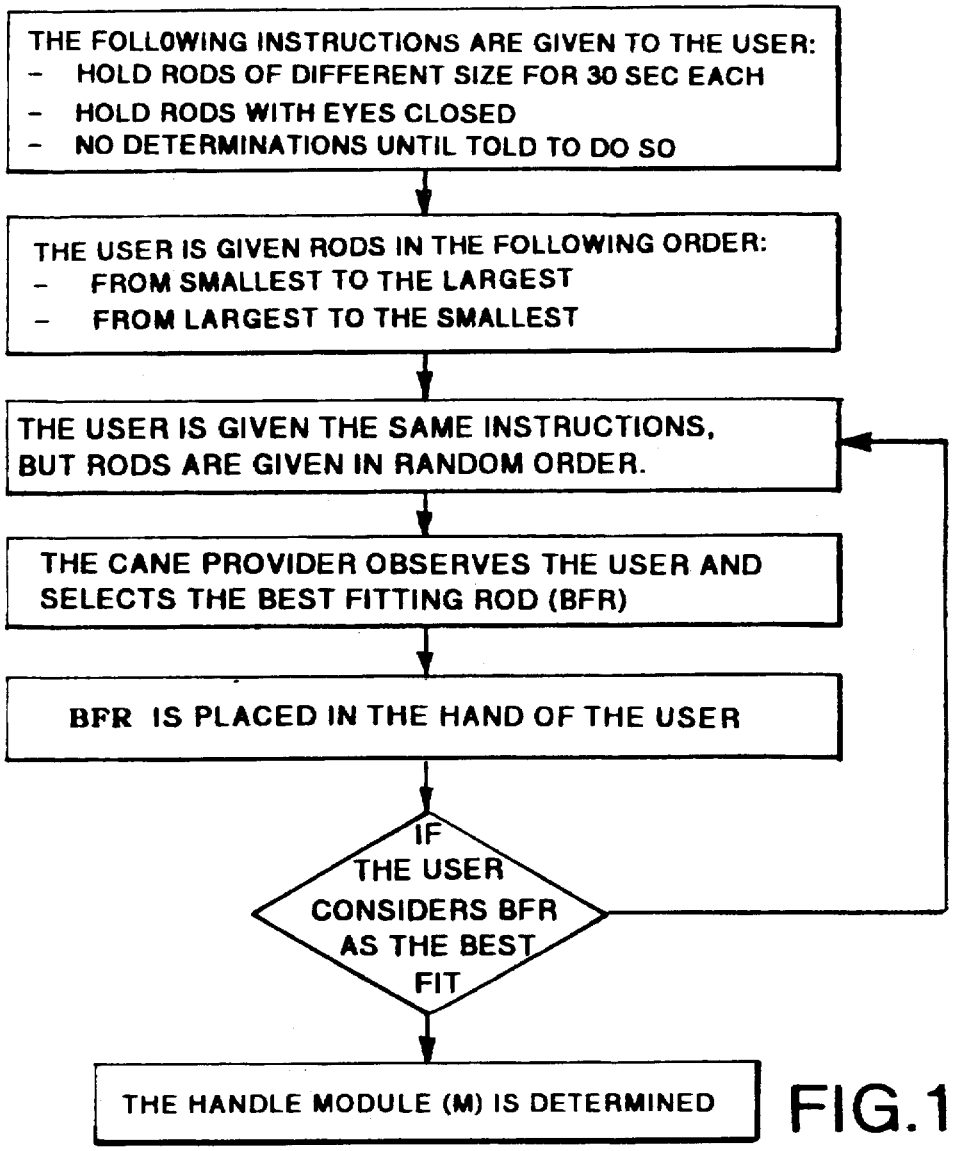
FIGS. 11 and 12 are flow diagrams of the measurement method.
Figure 12:
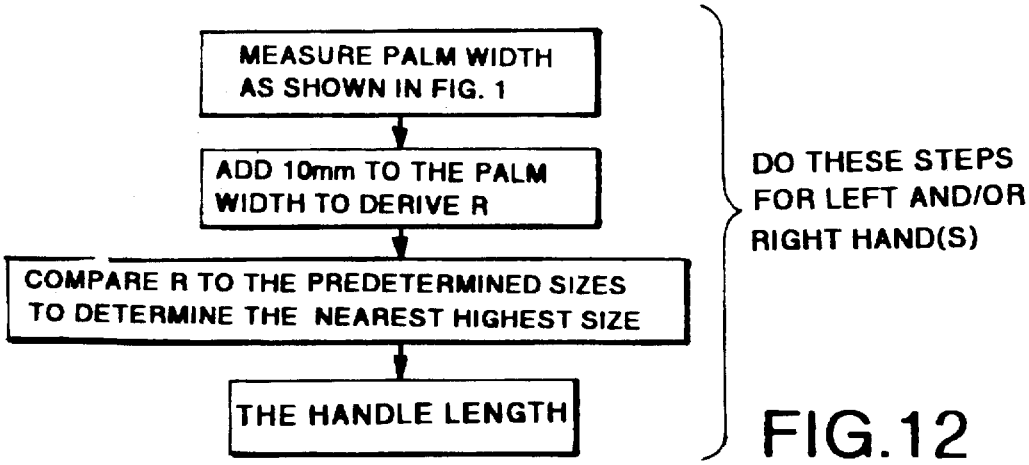

FIG. 11 shows a method to choose the best tactile fit of the individual user's hand to the handle. First, the user is given instructions which should be followed to successfully determine the handle module (M). The user will be given different size diameter rods 20–22, see FIG. 10. He will hold each rod, with closed eyes, for 30 seconds. He must not make any conclusions whether the particular rod fits until he is told to do so. Then, the user is given a number of rods, preferably at least 6. Each rod has a different diameter. For example, the diameters of the rods are 38-35-32-28-25-22 mm. The user is given the rods in the following order: from the smallest rod to the largest and then back to the smallest.

The second step: the user is given the same instructions as in the first step. Then the user is given rods randomly. The cane provider observes the user and selects the best fitting rod ("BFR"). Then, the user is given the BFR and questioned whether the BFR is the best fit. If the answer is positive the selection process is over and the BFR is determined to be the size of the handle module (M). Otherwise, the user has to repeat the second step until he selects the best fit.

I claim:

1. A cane comprising a shaft having a top and a bottom tip section, a basket portion, a handle secured at the top end of the shaft and an attachment plug, (a) the shaft comprising a thin, elongated lightweight member having an outer diameter in the range of from 0.32 to 0.8 inches;

(b) the attachment plug comprising a body member of lightweight elastomeric resilient foam material in the range of 15–40 lbs/cu.ft. density and weighing less than 5 ounces, the attachment plug having a longitudinal bore extending therethrough from an entrance end to a terminus end and the bore receiving therein the tip section of the shaft, the attachment plug body member having an upper face and a bottom face and including, at its bottom face, a rim to provide a steady base; and (c) the basket connected to the shaft proximate the tip section and resting on the plug body member proximate its upper face.

2. A cane as in claim 1 wherein the rim forms a cavity in the bottom face to provide a partial suction effect.

3. A cane as in claim 2 wherein the basket is disk-like and rests on the upper face.

4. A cane as in claim 1 wherein the shaft weighs less than 4 ounces.

5. A cane as in claim 1 wherein the attachment plug body member has an imaginary axis perpendicular to the ground, and the body member is round in all cross-sections perpendicular to the axis.

6. A cane as in claim 5 wherein the attachment plug rim has a plurality of protrusions thereon protruding parallel to the axis.

7. A cane as in claim 6 wherein the bore is through the body member so that the attachment plug may be inverted on the pole and the protrusions may be pushed against the ground.

8. A cane as in claim 1 wherein the shaft is of a composite carbon graphite plastic material.

9. A cane as in claim 1 wherein the shaft is of titanium.

10. A cane as in claim 1 wherein the body member is polyethylene micro-cell foam.

11. A cane comprising a shaft, a handle connected to the shaft, the shaft terminating in a tip section, a basket fixed onto the shaft adjacent the tip section, and an attachment plug enclosing the tip section of the shaft, the shaft comprising a lightweight member of less than 5 ounces weight and in the range of from 0.32 to 0.8 inches in outer diameter; the attachment plug comprising:

a body member of lightweight elastomeric resilient micro-cell foam material in the range of 15–40 lbs./cu.ft. density and having a longitudinal bore therein enclosing the tip section of the cane;

wherein the body member has a top face and a bottom face and includes, at its bottom face, a rim to provide a steady base, the rim forming a cavity in the bottom face to provide a suction effect when the attachment plug is pushed to ground;

wherein the basket rests on the top face of the attachment plug; and wherein the bore extends through the body member so that the attachment plug may be inverted on the pole.

* * * * *